US010855021B2

(12) United States Patent
Akagi

(10) Patent No.: US 10,855,021 B2
(45) Date of Patent: Dec. 1, 2020

(54) CONNECTOR

(71) Applicant: Yazaki Corporation, Tokyo (JP)

(72) Inventor: Yosuke Akagi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/273,636

(22) Filed: Feb. 12, 2019

(65) Prior Publication Data

US 2019/0252824 A1 Aug. 15, 2019

(30) Foreign Application Priority Data

Feb. 13, 2018 (JP) ..... 2018-022909

(51) Int. Cl.
*H01R 13/52* (2006.01)
*H01R 13/627* (2006.01)
*H01R 13/436* (2006.01)

(52) U.S. Cl.
CPC ..... *H01R 13/5219* (2013.01); *H01R 13/4364* (2013.01); *H01R 13/6272* (2013.01)

(58) Field of Classification Search
CPC ..... H01R 13/6272; H01R 13/641; H01R 13/527; H01R 13/627; H01R 24/64; H01R 24/20
USPC ..... 439/345
See application file for complete search history.

(56) References Cited

U.S. PATENT DOCUMENTS 7,311,546 B2 12/2007 Itou
2005/0130483 A1* 6/2005 Ishiyanna ..... H01R 13/6272 439/358
2008/0299816 A1 12/2008 Itou et al.
2009/0035980 A1* 2/2009 Nakamura ..... H01R 13/641 439/352
2014/0345936 A1* 11/2014 Aizawa ..... H01R 13/527 174/72 A
2016/0079703 A1* 3/2016 Nakashima ..... H01R 13/641 439/352

FOREIGN PATENT DOCUMENTS

CN 101316015 A 12/2008
JP 2007-080737 A 3/2007

* cited by examiner

*Primary Examiner* — Jean F Duverne
(74) *Attorney, Agent, or Firm* — Sughrue Mion, PLLC

(57) ABSTRACT

A connector includes a first housing including a receptacle, a second housing capable of being engaged with or disengaged from the receptacle, a locked portion provided in the first housing, a locking portion provided in the second housing capable of locking an engaged state of the first housing and the second housing by locking the locked portion, and a rib provided in one of the first housing and the second housing, which includes an inclined surface and a flat portion in sequence along the connecting direction of the first housing and the second housing. A position and a length of the rib and a position of the locking portion are set in such a manner that the first housing and the second housing start to be engaged in the order of the inclined surface of the rib, the locking portion, and the flat portion of the rib.

7 Claims, 9 Drawing Sheets

CONNECTOR

CROSS REFERENCE TO RELATED APPLICATION

The present application is based on, and claims priority from Japanese Patent Application No. 2018-022909, filed Feb. 13, 2018, the disclosure of which is hereby incorporated by reference herein in its entirety.

TECHNICAL FIELD

The present application relates to a connector capable of engaging/disengaging a female housing with/from a male housing.

BACKGROUND ART

As a connector of this type, there is a conventional connector disclosed in JP 2007-080737 A (Patent Family: U.S. Pat. No. 7,311,546 B2).

As illustrated in FIG. 10, the conventional connector includes a male connector 2 having a male housing 3 made of a synthetic resin on which a tubular receptacle 4 is formed, and a female connector 5 having a female housing 6 made of a synthetic resin that can be engaged with or disengaged from the receptacle 4 of the male housing 3. A male terminal A is accommodated in the male housing 3. A female terminal B is accommodated in a terminal holding portion 7 of the female housing 6 on which a holding cap 9 is mounted.

When the male housing 3 and the female housing 6 are engaged with each other, the terminal holding portion 7 of the female housing 6 on which the holding cap 9 is mounted is inserted into the receptacle 4 of the male housing 3. At the same time, a tubular covering portion 8 formed on the outer side of the terminal holding portion 7 of the female housing 6 is fitted to the outer circumference of the receptacle 4. At this time, both a first rib 9*a* projecting from the front-end outer circumferential surface of the holding cap 9 and a second rib 8*a* projecting from the rear-end inner circumferential surface of the tubular covering portion 8 are brought into contact with the receptacle 4 of the male housing 3. Accordingly, it is possible to reduce backlash and inclination in the radial direction between the male housing 3 and the female housing 6.

SUMMARY

However, in the conventional connector 1, in a case where tolerance of the receptacle 4 of the male housing 3 is large, the second rib 8*a* at the rear-end inner circumferential surface of the covering portion 8 and the first rib 9*a* at the front-end outer circumferential surface of the holding cap 9 do not function, whereby backlash and inclination cannot be suppressed.

The present application has been conceived to solve the problems described above, and an object of the present application is to provide a connector capable of, at the time of engaging a female housing and a male housing with each other, suppressing backlash and inclination between the female housing and the male housing and smoothly engaging the female housing and the male housing with each other.

A connector according to an aspect of the present application includes: a first housing including a receptacle; a second housing capable of being engaged with or disengaged from the receptacle; a locked portion provided in the first housing; a locking portion provided in the second housing, which is capable of locking an engaged state of the first housing and the second housing by locking the locked portion; and a rib provided in either one of the first housing and the second housing, which includes an inclined surface and a flat portion in sequence along the connecting direction of the first housing and the second housing. A position and a length of the rib and a position of the locking portion are set in such a manner that the first housing and the second housing start to be engaged with each other in the order of the inclined surface of the rib, the locking portion, and the flat portion of the rib.

The connector according the aspect of the present application is capable of suppressing backlash and inclination between the female housing and the male housing at the time of engaging the female housing and the male housing with each other, whereby the female housing and the male housing can be smoothly engaged with each other.

DESCRIPTION OF EMBODIMENTS

Figure 1:
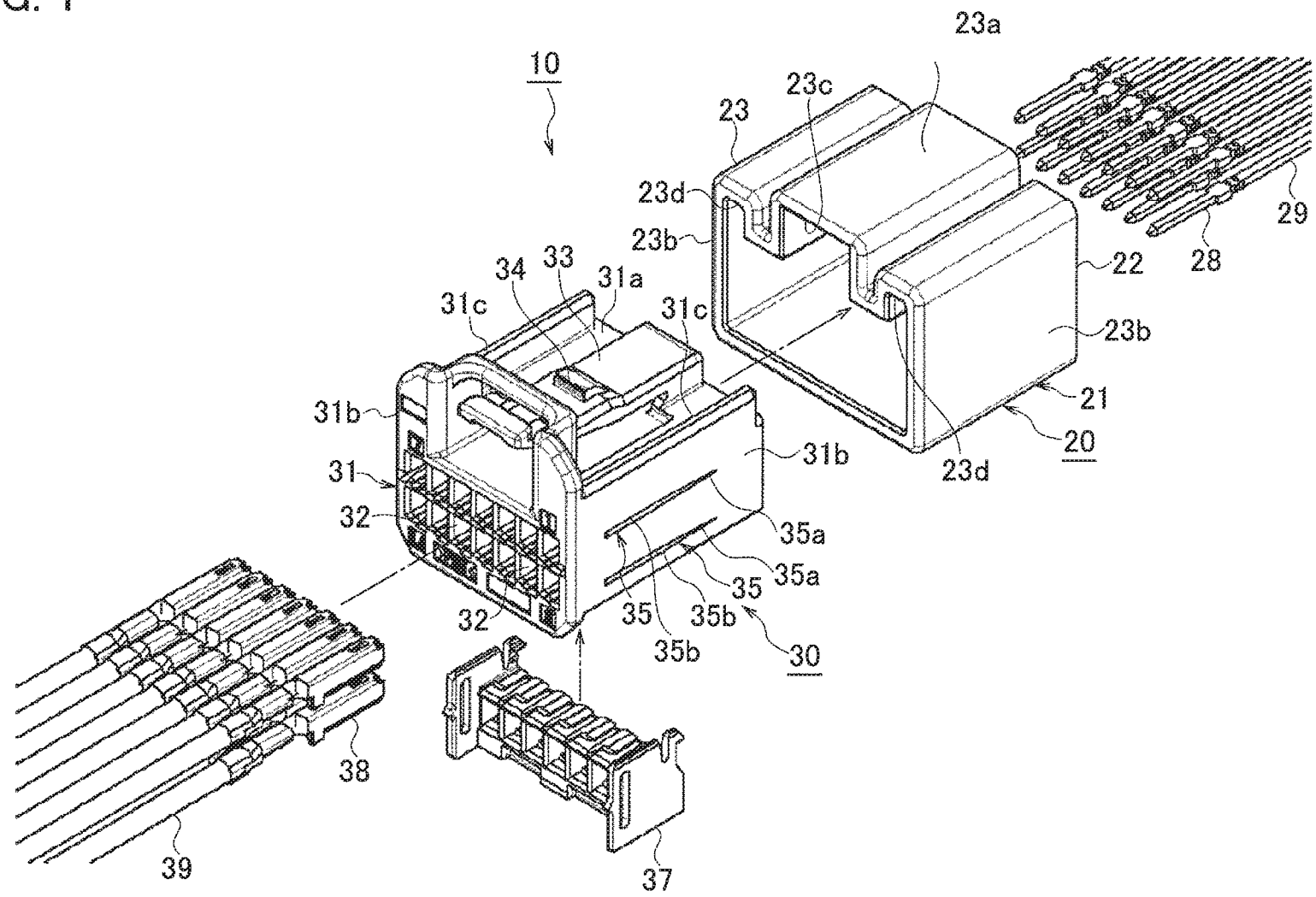
FIG. 1 is an exploded perspective view of a connector according to an embodiment.

Hereinafter, a connector according to an embodiment will be described with reference to the drawings.

As illustrated in FIGS. 1 to 4B, a connector 10 according to the embodiment is a connector to be directly connected to devices, which includes a female connector 20 having a female housing (first housing) 21 made of a synthetic resin for accommodating a plurality of male terminals (first terminals) 28, and a male connector 30 having a male housing (second housing) 31 made of a synthetic resin for accommodating a plurality of female terminals (second terminals) 38.

The female housing 21 includes a terminal mounting portion 22 in a rectangular plate shape to which a plurality of male terminals 28 is mounted, and a receptacle 23 it a rectangular tubular shape integrally formed to extend forward from the terminal mounting portion 22. On the inner surface of an upper wall 23*a* of the receptacle 23, a hook-like locked portion 24 to be engaged with a locking portion 34 of the male housing 31 is integrally formed in a projected manner.

Figure 4A:
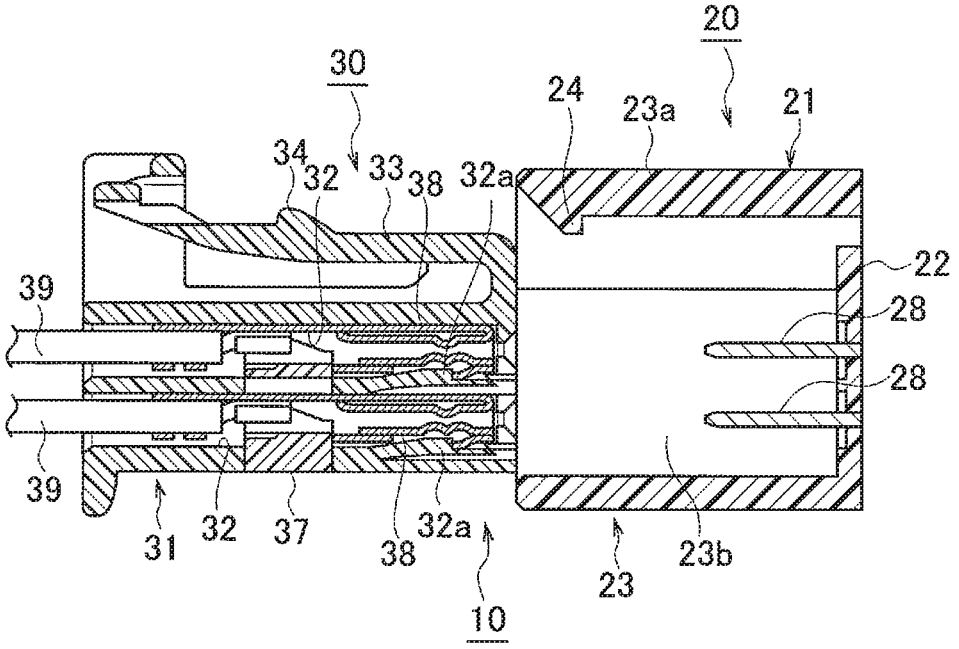
FIG. 4A is a cross-sectional view taken along line A-A in FIG. 2.

The male housing 31 is formed in a block shape, and is provided with a plurality of terminal housing chambers 32 formed on the side lower than the center. As illustrated in FIG. 4A, the female terminals 38 accommodated in the plurality of terminal housing chambers 32 are primarily locked by flexible lances 32*a*, and are secondarily locked by a spacer 37 made of a synthetic resin, which is mounted from the lower side of the male housing 31.

On the upper surface 31*a* of the male housing 31, there is provided an elastically deformable lock arm 33 integrally formed in a projected manner, on which the hook-like locking portion 34, which locks the locked portion 24 of the female housing 21 to lock the engaged state at the time of engaging with the receptacle 23 of the female housing 21, is formed.

Figure 2:
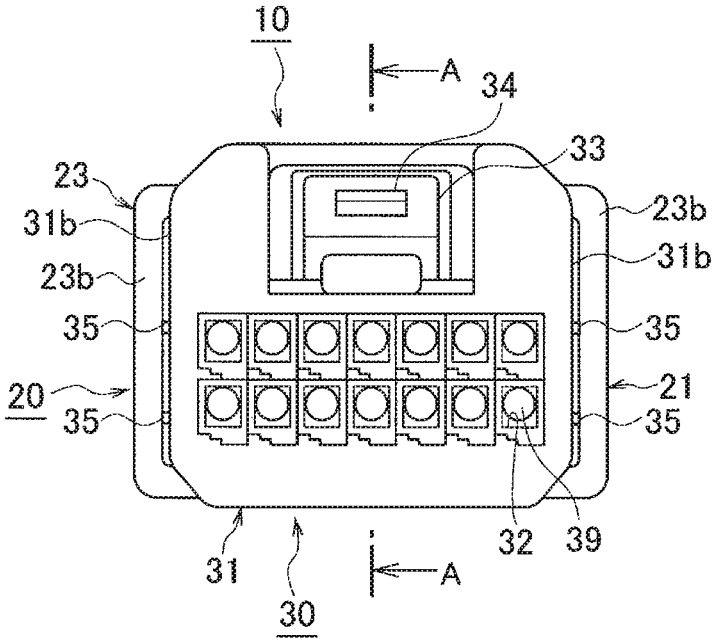
FIG. 2 is a front view of the connector according to the embodiment before engagement.
Figure 3:
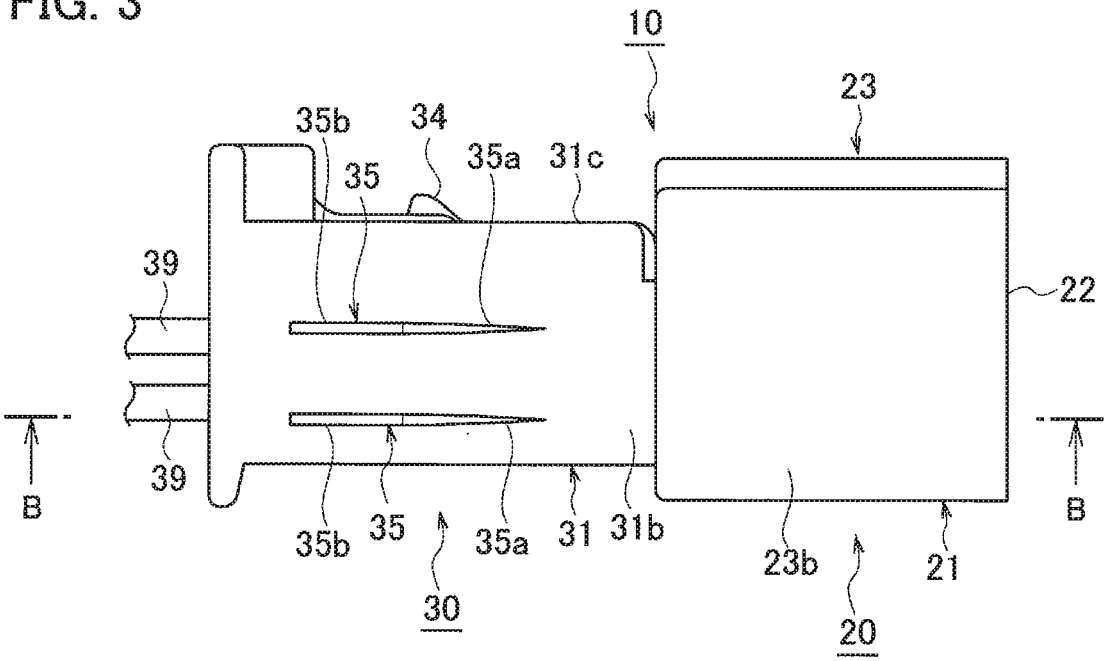
FIG. 3 is a side view of the connector according to the embodiment before engagement.

As illustrated in FIGS. 1 to 3, at a substantially center and a lower side of each of side surfaces 31*b* of the male housing 31, a pair of upper and lower ribs 35 is integrally formed in a projected manner. Each of the ribs 35 is positioned away from a front end of male housing 31in the connecting direction. Each of the ribs 35 has an inclined surface 35*a* and a flat portion 35*b* along the connecting direction in that order. As illustrated in FIGS. 5A to 7B, in each of the ribs 35, the position and the relative length of the inclined surface 35*a* are determined in such a manner that it starts to contact with the inner surface of a side wall 23*b* of the receptacle 23 in the order of the inclined surface 35*a*, the locking portion 34, and the flat portion 35*b*. The inclined surface 35*a* is a triangular inclined surface continuing to the flat portion 35*b*, and its tip is tapered. The flat portion 35*b* has a rectangular parallelepiped shape.

The relationship of insertion force at the start of contact between the female housing 21 and the male housing 31 is set to increase in the order of the inclined surface 35*a*, the locking portion 34, and the flat portion 35*b* (inclined surface 35*a*<locking portion 34<flat portion 35*b*). Accordingly, the female housing 21 and the male housing 31 can be gently engaged with each other.

Figure 8A:
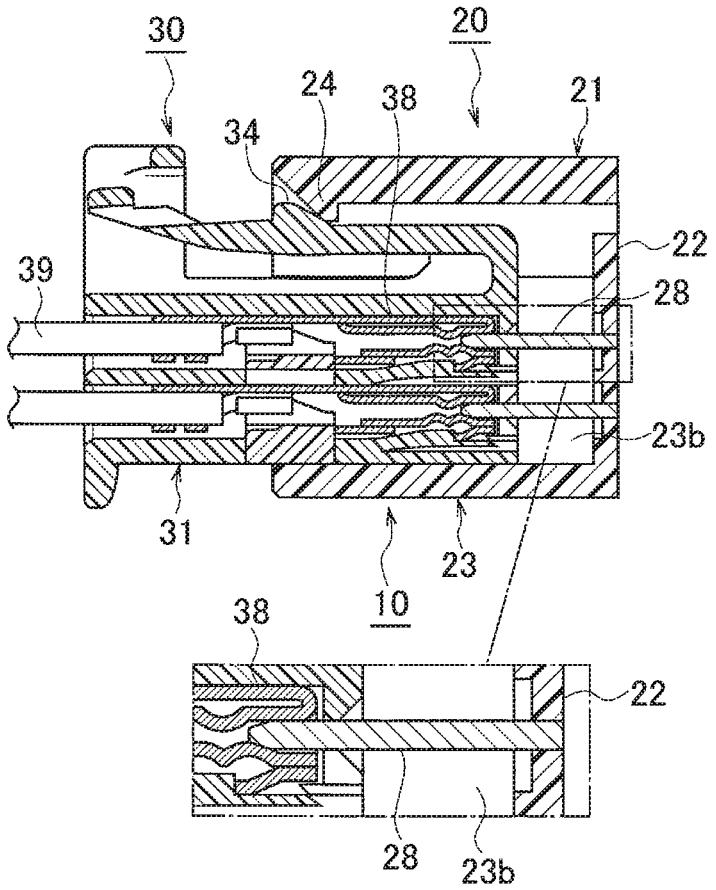
FIG. 8A is a cross-sectional view taken along the line A-A in FIG. 2 illustrating a state in which a terminal of the connector according to the embodiment starts to contact.
Figure 8B:
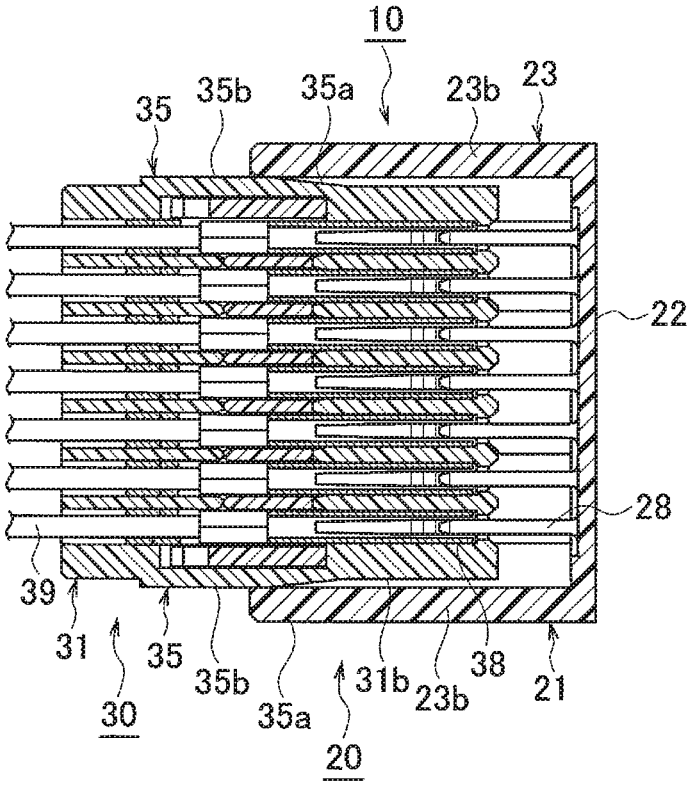
FIG. 8B is a cross-sectional view taken along the line B-B in FIG. 3 illustrating the state in which the terminal of the connector according to the embodiment starts to contact.

As illustrated in FIGS. 8A and 8B, after the flat portion 35*b* of each of the ribs 35 is brought into contact with the inner surface of the side wall 23*b* of the receptacle 23, the male terminals 28 in the female housing 21 and the female terminals 38 in the male housing 31 abut on each other and connected to each other.

As illustrated in FIG. 1, a recessed portion 23*c* into which the lock arm 33 of the male housing 31 is inserted is formed in the center of the upper wall 23*a* of the receptacle 23. On both sides of the upper wall 3*a* of the receptacle 23, a pair of guide portions 23*d*, into which projecting portions 31*c* standing upward from the side surfaces 31*b* of the male housing 31 are inserted, is formed in a recessed state. Cables 29 are connected to the respective male terminals 28. Cables 39 are connected to the respective female terminals 38.

Figure 4B:
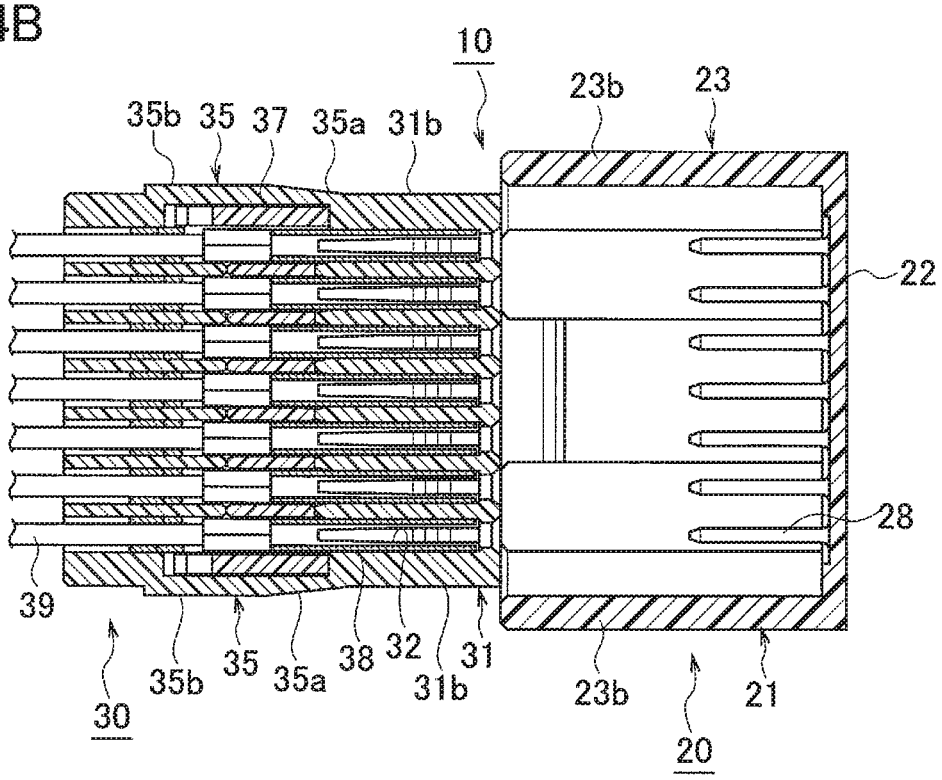
FIG. 4B is a cross-sectional view taken along line B-B in FIG. 3.
Figure 5A:
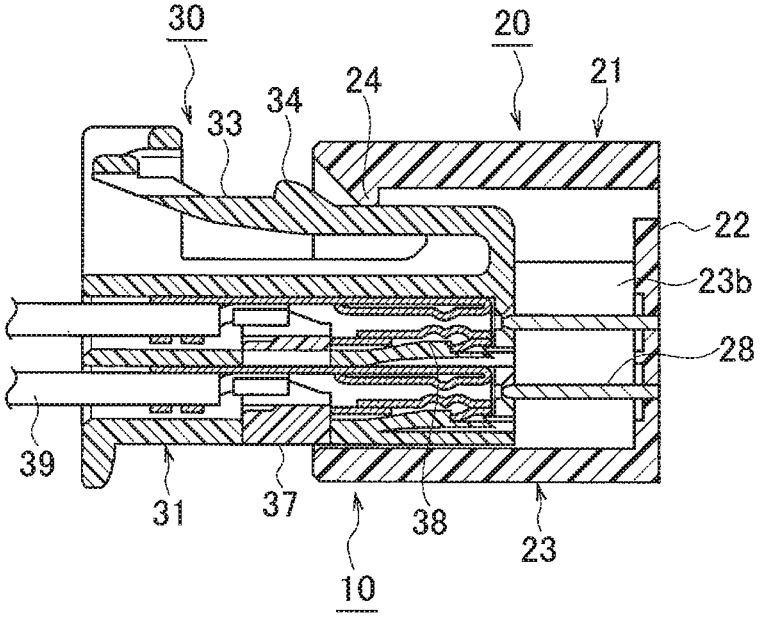
FIG. 5A is a cross-sectional view taken along the line A-A in FIG. 2 illustrating a state in which a rib of the connector according to the embodiment starts to contact.
Figure 5B:
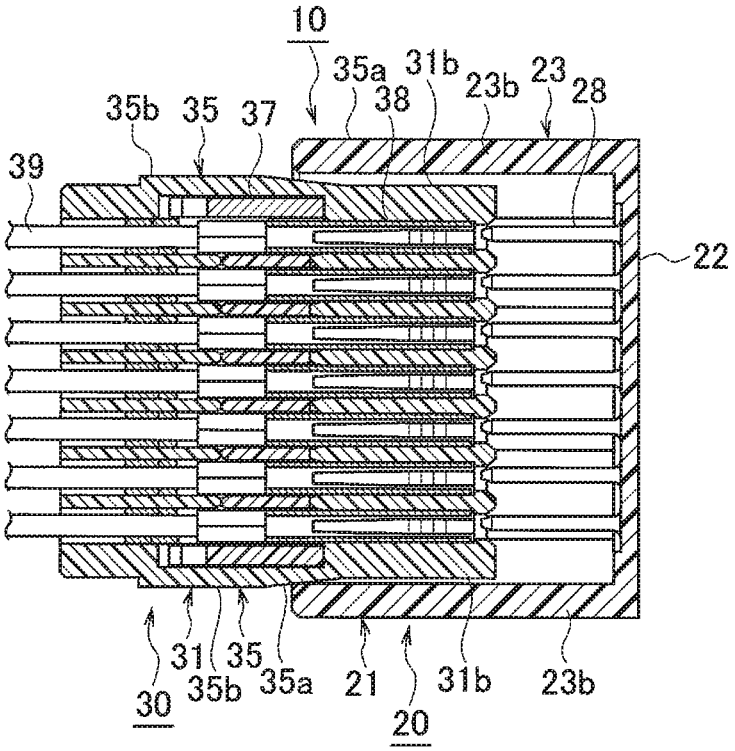
FIG. 5B is a cross-sectional view taken along the line B-B in FIG. 3 illustrating the state in which the rib of the connector according to the embodiment starts to contact.

As described above, in the connector 10 according to the embodiment, when the male housing 31 is inserted into the receptacle 23 of the female housing 21 as illustrated in FIGS. 3, 4A, and 4B, the inclined surface 35*a* of each of the ribs 35 formed on the side surfaces 31*b* of the male housing 31 starts to be in contact with the inner surface of the side wall 23*b* of the receptacle 23 of the female housing 21 as illustrated in FIGS. 5A and 5B.

Figure 6A:
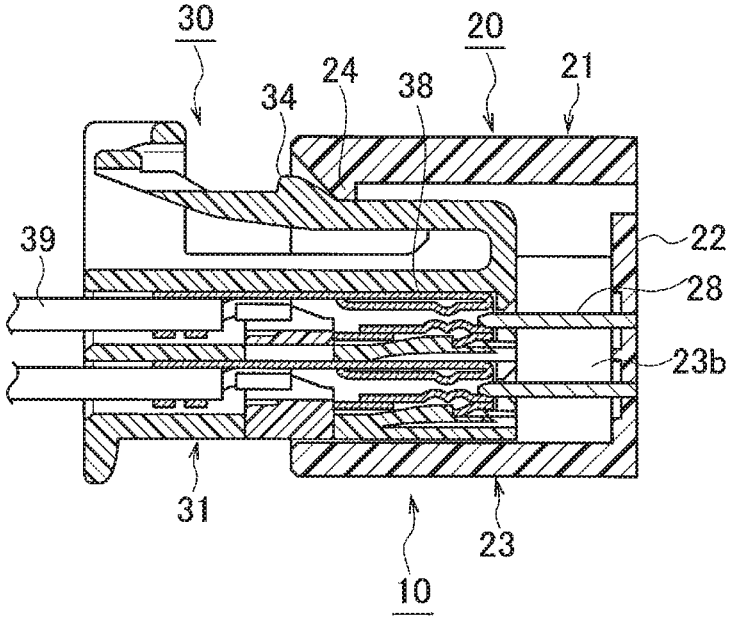
FIG. 6A is a cross-sectional view taken along the line A-A in FIG. 2 illustrating a state in which a locking portion of the connector according to the embodiment starts to contact.
Figure 6B:
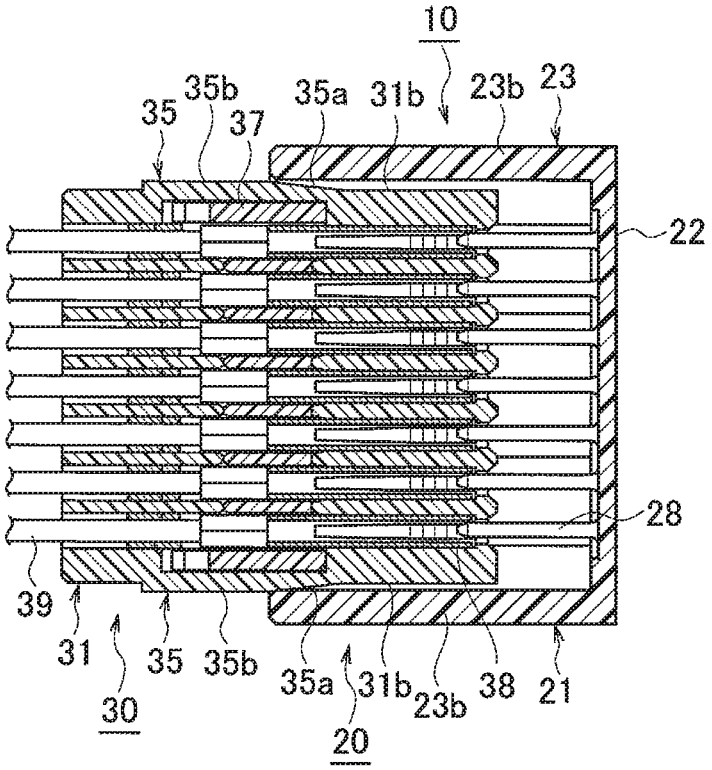
FIG. 6B is a cross-sectional view taken along the line B-B in FIG. 3 illustrating the state in which the locking portion of the connector according to the embodiment starts to contact.

When the male housing 31 is further inserted into the receptacle 23 of the female housing 21 as illustrated in FIGS. 6A and 6B, the locking portion 34 starts to be in contact with the locked portion 24.

Figure 7A:
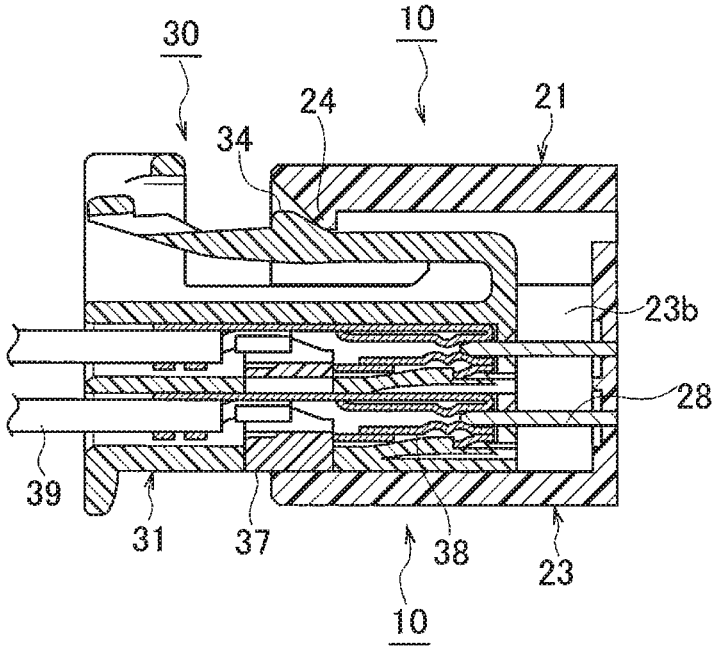
FIG. 7A is a cross-sectional view taken along the line A-A in FIG. 2 illustrating a state in which the rib of the connector according to the embodiment has been engaged.
Figure 7B:
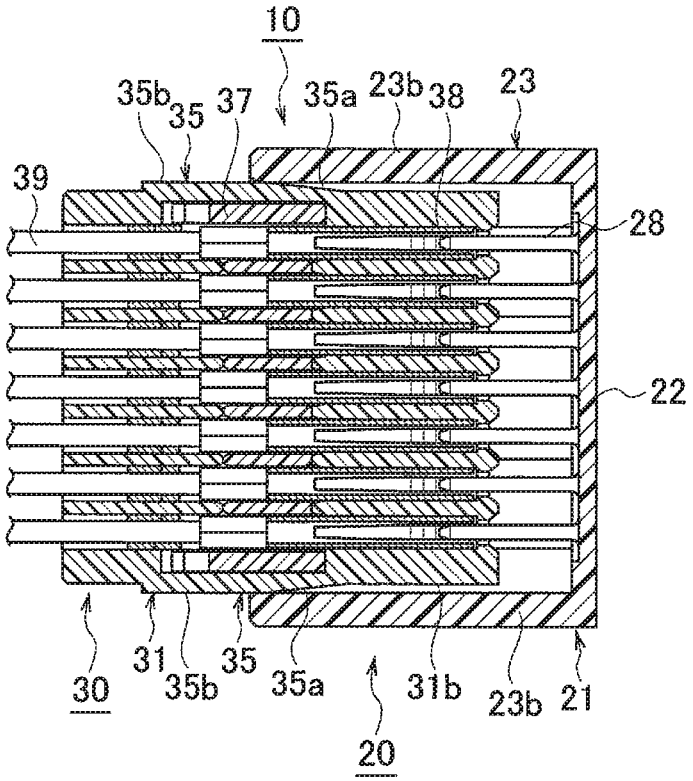
FIG. 7B is a cross-sectional view taken along the line B-B in FIG. 3 illustrating the state in which the rib of the connector according to the embodiment has been engaged.

Then, as illustrated in FIGS. 7A and 78, the flat portion 35*b* of each of the ribs 35 abuts on the inner surface of the side wall 23*b* of the receptacle 23, whereby the engagement of the ribs 35 with the receptacle 23 is complete.

When the ribs 35 are engaged with the receptacle 23, first, the inclined surface 35*a* of each of the ribs 35 is engaged with the receptacle 23, whereby fitting force is gently applied. When the receptacle 23 rides on the inclined surface 35*a* of each of the ribs 35, the backlash reducing function is complete. That is, at the time of engaging the male housing 31 with the receptacle 23 of the female housing 21, backlash and inclination between the receptacle 23 of the female housing 21 and the male housing 31 can be easily and reliably suppressed.

Figure 9A:
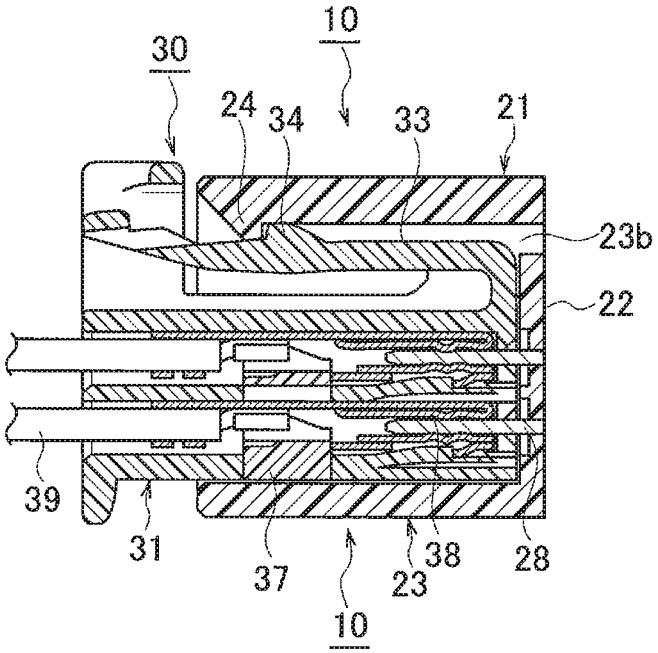
FIG. 9A is a cross-sectional view taken along the line A-A in FIG. 2 illustrating a state in which the connector according to the embodiment has been engaged.
Figure 9B:
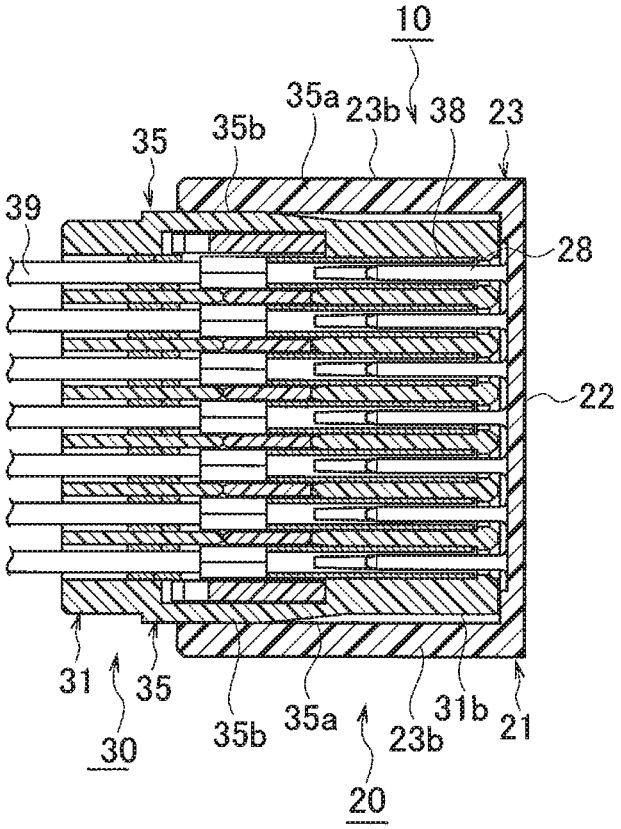
FIG. 9B is a cross-sectional view taken along the line B-B in FIG. 3 illustrating the state in which the connector according to the embodiment has been engaged.
Figure 10:
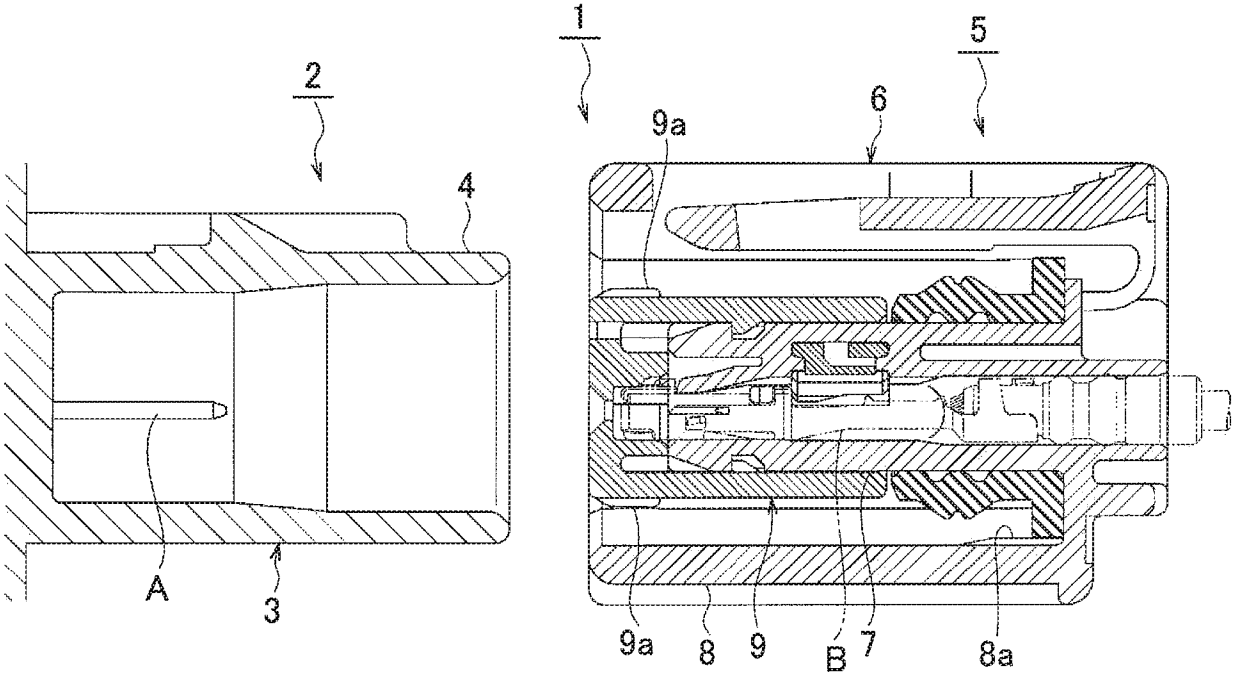
FIG. 10 PRIOR ART
FIG. 10 is a cross-sectional view of a conventional connector.

Then, after the flat portion 35*b* of each of the ribs 35 of the male housing 31 is brought into contact with the inner surface of the side wall 23*b* of the receptacle 23 of the female housing 21, as illustrated in FIGS. 8A and 8B, the male terminals 28 in the female housing 21 and the female terminals 38 in the male housing 31 start to be in contact with each other. Then, as illustrated in FIGS. 9A and 98, the female housing 21 and the male housing 31 are engaged with each other by further inserting the male housing 31 into the receptacle 23 of the female housing 21. The locked portion 24 of the female housing 21 is locked by the locking portion 34 of the male housing 31, whereby the engaged state of the female housing 21 and the male housing 31 is maintained.

By providing the inclined surface 35*a* at the tip of each of the ribs 35, at the time of inserting the male housing 31 into the receptacle 23 of the female housing 21, inclination of the male housing 31 can be suppressed, the insertion force with respect to the inner surface of the side wall 23*b* of the receptacle 23 becomes gentle, and backlash reduction, terminal insertion, and lock engagement can be made smooth, whereby insertion-coupling feeling between the female housing 21 and the male housing 31 can be improved.

Note that, although the ribs 35 for suppressing the inclination are provided on the side surfaces of the male housing 31 in the embodiment, the ribs for suppressing the inclination may be provided on the inner surfaces of the side walls 23*b* of the receptacle 23 of the female housing 21.

What is claimed is:

1. A connector, comprising:

a first housing including a receptacle;

a second housing capable of being engaged with or disengaged from the receptacle;

a locked portion provided in the first housing;

a locking portion provided on a top surface of the second housing, the locking portion being capable of locking an engaged state of the first housing and the second housing by locking the locked portion; and a rib provided on a central portion of a side surface in either one of the first housing and the second housing, the rib including an inclined surface and a flat portion in sequence along a connecting direction of the first housing and the second housing, wherein a position and a length of the rib and a position of the locking portion are set in such a manner that the first housing and the second housing start to be engaged with each other in the order of the inclined surface of the rib, the locking portion, and the flat portion of the rib.

2. The connector according to claim 1, wherein the rib is provided at a position away from a front end in the connecting direction of either one of the first housing and the second housing.

3. The connector according to claim 1, wherein the rib includes at least one pair of ribs including an upper rib and a lower rib provided on the central portion of the side surface of either one of the first housing and the second housing.

4. The connector according to claim 1, further comprising:

a first terminal provided inside the first housing; and a second terminal provided inside the second housing, wherein the first terminal and the second terminal are fixed at a position where the first terminal inside the first housing and the second terminal inside the second housing abut on each other after the flat portion of the rib of either one of the first housing and the second housing abuts on the other one of the first housing and the second housing.

5. The connector according to claim 1, wherein the rib is provided on the central portion of the side surface of the second housing, and, as the first and second housing start to engage with each other, the rib engages a side wall of the receptacle of the first housing.

6. The connector according to claim 1, wherein the inclined surface of the rib extends from a position near the front end of the first housing to a position after the locking portion.

7. The connector according to claim 1, wherein the flat portion of the rib extends from a position after the locking portion to a position proximate the rear end of the first housing.

* * * * *